United States Patent [19]

Barnhart et al.

[11] Patent Number: 4,868,400

[45] Date of Patent: Sep. 19, 1989

[54] DUCTILE IRON CASK WITH ENCAPSULATED URANIUM, TUNGSTEN OR OTHER DENSE METAL SHIELDING

[75] Inventors: Victor J. Barnhart, Columbia; Robert T. Anderson, Aiken, both of S.C.

[73] Assignee: Chem-Nuclear Systems, Inc., Columbia, S.C.

[21] Appl. No.: 112,835

[22] PCT Filed: Sep. 2, 1987

[86] PCT No.: PCT/US87/02182

§ 371 Date: Sep. 5, 1987

§ 102(e) Date: Sep. 5, 1987

[87] PCT Pub. No.: WO89/02153

PCT Pub. Date: Mar. 9, 1989

[51] Int. Cl.[4] ..... G21F 5/00

[52] U.S. Cl. ..... 250/506.1; 250/518.1; 376/272

[58] Field of Search ..... 250/518.1, 506.1, 507.1; 376/288, 272

[56] References Cited

U.S. PATENT DOCUMENTS

| | | | |
|---|---|---|---|
| Re. 29,876 | 1/1979 | Reese | 250/506 |
| 2,716,705 | 8/1955 | Zinn | 250/108 |
| 3,016,462 | 1/1962 | Hendricksen et al. | 250/506.1 |
| 3,297,541 | 1/1967 | Dickson | 376/288 |
| 3,732,427 | 5/1973 | Trudeau et al. | 250/108 R |
| 3,888,794 | 6/1975 | Kasberg | 376/288 |
| 4,123,392 | 10/1978 | Hall et al. | 252/478 |
| 4,147,938 | 4/1979 | Heckman et al. | 250/506 |
| 4,272,683 | 6/1981 | Baatz et al. | 250/506.1 |
| 4,288,698 | 9/1981 | Baatz et al. | 250/506 |
| 4,339,411 | 7/1982 | Knackstedt et al. | 250/506.1 |
| 4,399,366 | 8/1983 | Bucholz | 376/272 |
| 4,445,042 | 4/1984 | Baatz et al. | 250/506.1 |
| 4,451,739 | 5/1984 | Christ et al. | 250/506.1 |
| 4,453,081 | 6/1984 | Christ et al. | 250/506.1 |
| 4,752,437 | 6/1988 | Ito et al. | 250/506.1 |

*Primary Examiner*—Bruce C. Anderson
*Attorney, Agent, or Firm*—Benoni O. Reynolds

[57] ABSTRACT

In a cask (10) for the transportation and storage of radioactive materials, an improvement in the shielding means (14) which achieves significant savings in weight and increases in payload by the use of pipes of depleted uranium, tungsten or other dense metal, encapsulating polyethylene cores (20*a*), dispersed in two to four rows of concentric bore holes (20, 21, 22, 23 or 24) around the periphery of the cask body (11) which is preferably made of ductile iron. Alternatively, rods or small balls of these same shielding materials (21*a*, 22*a*, 23*a* and 24*a*), alone or in combination, are placed in these bore holes. The thickness, number and arrangement of these shielding pipes (20*a*) or rods (21*a*, 22*a*, 23*a* or 24*a*) is varied to provide optimum protection against the neutrons and gamma radiation emitted by the particular radioactive material being transported or stored.

3 Claims, 2 Drawing Sheets

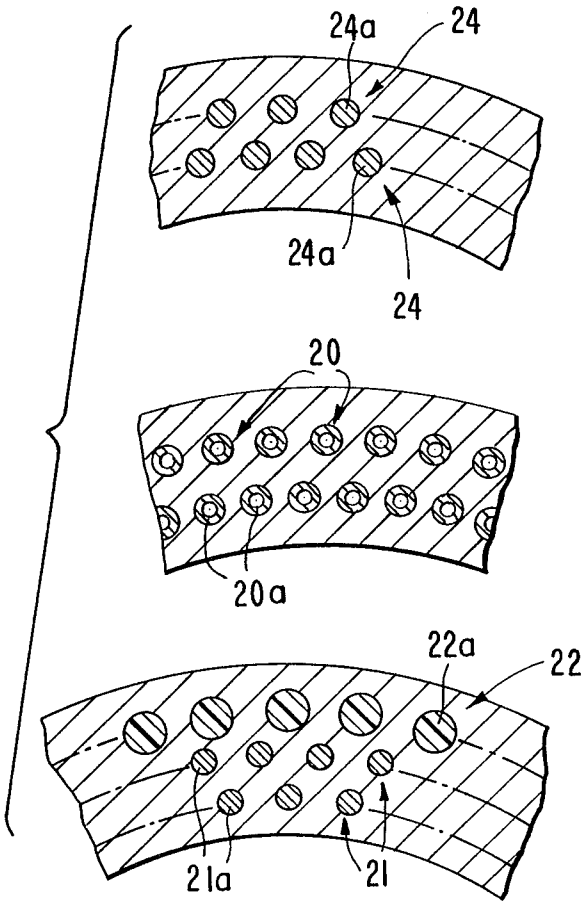
FIG. 4.
FIG. 1.
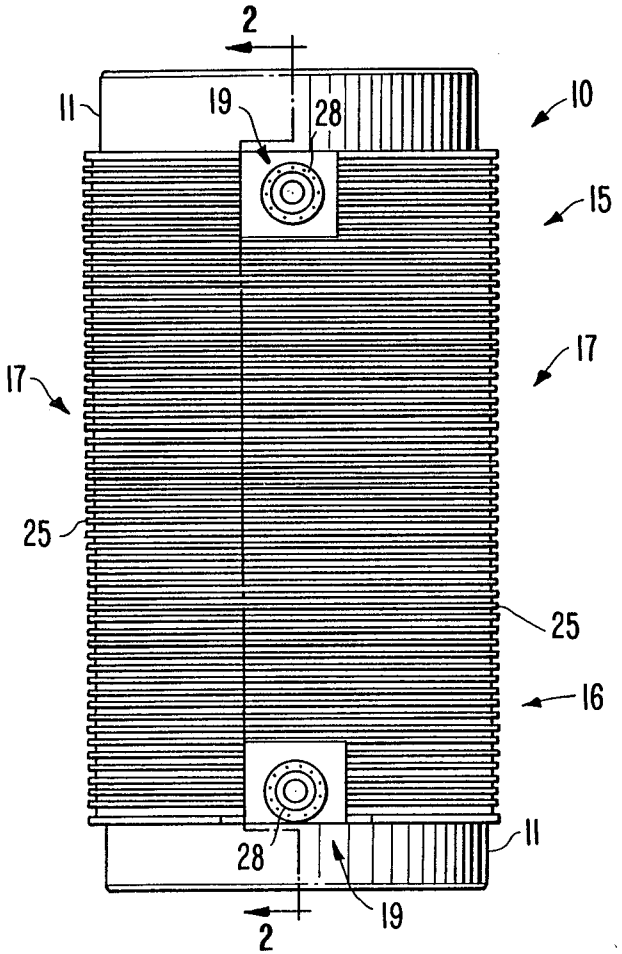

DUCTILE IRON CASK WITH ENCAPSULATED URANIUM, TUNGSTEN OR OTHER DENSE METAL SHIELDING

TECHNICAL FIELD

The invention relates to casks for the transportation and storage of radioactive materials. More specifically the invention relates to an improvement in cask design to reduce the weight and increase the payload, yet protect the handlers of the cask from the radiation emitted by the radioactive material being transported or stored.

BACKGROUND ART

Radioactive material must be stored and transported in containers that not only provide adequate interior capacity and structural integrity, but also shield those persons who handle the containers from the radioactivity of the material contained. For the type of radioactive material that is known as spent nuclear fuel, considerable shielding is necessary.

Spent nuclear fuel, and certain other types of radioactive waste, emits a great deal of gamma radiation and neutrons. Shielding gamma radiation is accomplished by making the container or spent fuel cask sufficiently massive. Higher density materials allow thinner-walled casks; lower density materials lead to thicker-walled casks.

Spent nuclear fuel also emits neutrons which are a form of radiation. Neutrons can be shielded best with certain kinds of material, notably those materials with a large number of hydrogen atoms.

In addition to capacity, structural integrity, and shielding, spent nuclear fuel casks must allow for the dissipation of heat energy from the radioactive decay taking place in the fuel. This decay heat can cause internal stresses when dissimilar materials are heated or when too great a heat gradient is established across a material used in cask construction.

There are two other considerations that limit the cask designer: weight and cost of the cask. For a cask that travels over the road, state highway restrictions disfavor vehicles weighing more than 80,000 pounds. Furthermore, greater cask weight can make loading and unloading more difficult.

The cost of materials and fabrication is a significant component of the costs of spent nuclear fuel storage and transportation. Another component is the number of casks needed for a given quantity of fuel. If cask payloads are small, more casks are needed to store and transport that quantity of spent nuclear fuel.

Thus, the cask designer is faced with competing choices of shape and materials for strength and shielding both gamma radiation and neutrons, while keeping weight and cost as low as possible.

Casks of various configurations have been constructed in the prior art to serve as containers for the transportation and storage of radioactive materials. Typically, they are cylindrical or square containers of cement or a dense metal such as steel or cast iron, having an inner cavity in which radioactive material being transported or stored is placed. These containers have heavy lids and trunnions to which lifting cables may be attached. The cask bodies are frequently composed of concentric layers of materials that provide structural strength and shielding. Until the present invention, the prior art has not successfully made any breakthrough in increasing payload without corresponding increases in weight. As the preferred embodiment of the present invention is the novel deployment of depleted uranium as shielding material in the form of pipes having polyethylene cores or in the form of rods, dispersed in a highly flexible pattern of bore holes around the periphery of a ductile iron cask, the discussion of the relevant art will be primarily directed to the prior use of uranium as a shielding material. Tungsten or other dense metal rods, as well as polyethylene rods, are viewed as alternative or additional shielding materials.

The use of shielding of multilayer construction was first noted in the radiation shield of Zinn in 1955 (U.S. Pat. No. 2,716,705). His shield comprised one or more layers of a neutron absorbing or shielding material and one or more layers of a gamma and neutron shielding material. Concrete, paraffin and steel shot were his protective materials. The Pat. No. of Trudeau et al. of 1973 (U.S. Pat. No. 3,732,427) illustrates an integrated transport system of that day. He mentions in his disclosure that the shielding used at the time was suitable only to attenuate gamma radiation and not the then recently discovered fast neutrons. Also, he mentions the use of lead, or lead and depleted uranium combined, as shielding materials. His claimed cask had an intermediate box-like barrier of depleted uranium which was 1½inches thick. Also, his container had a barrier of hydrogenous material, wet plaster, to attenuate neutrons.

Hall's patent of 1978 (U.S. Pat. No. 4,123,392) discloses the method and use of non-combustible material, e.g. cement, containing various hydrogenous materials, such as plastic and resins, as shielding against neutrons. Reese's Pat. of 1979 (U.S. Pat. No. Re. 29,876) discloses an improved method of dissipating heat by fins externally located on the container. He mentions the possible use of depleted uranium as a beta radiation/gamma radiation absorbing material disposed between a central cavity for holding the radioactive material and an outer wall of corrosion resistant material. Heckman et al. in 1979 (U.S. Pat. No. 4,147,938) disclosed a system of bimetallic bands which expand when exposed to external heat to prevent fire damage to the inner portion of the cask. He mentions depleted uranium as material suitable for gamma shielding and hydrogenous materials for neutron shielding.

Baatz et al. in 1981 (4,272,683) discloses a transportation and storage vessel in which the intermediate layer of the body is a cast metal matrix in which uranium balls are embedded and the outer layer has channels containing a neutron absorber such as boron carbide and/or a moderator such as paraffin. A companion patent of Baatz et al., also in 1981 (U.S. Pat. No. 4,288,698), discloses a cask which contemplates a matrix of cast metal in which gamma-radiation absorbers are embedded. Also, he introduces the use of bore holes to hold neutron moderator material, in this case, water.

Christ et al. in 1984 (U.S. Pat. No. 4,451,739) discloses shielding for gamma radiation consisting of wire wrapped around the storage portion of the container. A jacket made of uranium, lead or steel is mentioned as a gamma radiation shield. Also, hollow spaces are disclosed between the layers of metal to be filled with neutron shielding material. A second Christ et al. patent, also in 1984 (4,453,081), emphasizes the use of graphite and boron carbide as neutron shielding materials.

Prior art known to this inventor includes the following U.S. Pat. Nos:

| | | |
|---|---|---|
| 2,716,705 | 8/1955 | Zinn |
| 3,732,427 | 5/1973 | Trudeau et al. |
| 4,123,392 | 11/1978 | Hall et al. |
| Re. 29,876 | 1/1979 | Reese |
| 4,147,938 | 4/1979 | Heckman et al. |
| 4,272,683 | 6/1981 | Baatz et al. |
| 4,288,698 | 9/1981 | Baatz et al. |
| 4,451,739 | 5/1984 | Christ et al. |
| 4,453,081 | 6/1984 | Christ et al. |

INDUSTRIAL APPLICABILITY

The objectives of the present invention are to provide improved shielding in a cask (preferably of ductile iron) for transporting and storing radioactive materials which:

(1) will protect handlers of such casks from the radiation emitted by the radioactive material being transported or stored;

(2) will provide greater public security for the radioactive material during the transportation process;

(3) enable a reduction in the size and weight of cask required for a particular quantity of radioactive material; or (4) in the alternative, will increase the quantity of radioactive material which may be shipped in relation to the gross weight of the cask;

(5) will prevent the degradation of the heat transfer properties of the cask by permitting a continuous radial flow of heat;

(6) permit optimization of gamma and neutron shielding to accommodate a variety of radioactive materials utilizing the same structural design:

(7) increase the payload efficiency in terms of the weight of payload carried in relation to the gross weight of the cask.

Other objectives and advantages of the present invention will be apparent during the course of the following detailed description.

DISCLOSURE OF INVENTION

Our invention is improved shielding in a cask (preferably of ductile iron) for transporting and storing radioactive material such as spent fuel assemblies from Pressurized Water Reactors (PWR) and Boiling Water Reactors (BWR). The improved shielding achieves certain economies of weight and corresponding increases in payload by the use of pipes of depleted uranium, tungsten or other dense metal encapsulating polyethylene, and rods of these same materials, as shielding against neutrons and gamma radiation emitted by the radioactive material being transported or stored therein.

According to the preferred embodiment of the cask containing the present invention, the main components are a basket means and cavity means, surrounded by a shielding means and cooling means, all encased in a cask body which is preferably made of ductile iron. Ductile iron, although less dense than lead, provides superior strength. Aluminum would also be an alternative material.

A basket means is provided within the cask for holding the radioactive material in a secure manner. A cavity means is provided within the cask for enclosing the basket means. A shielding means is provided within the cask for protecting handlers of the cask from the radiation emitted by any radioactive material being transported or stored. A cask body, having an upper portion and lower portion, is provided for housing the basket means, the cavity means and the shielding means. Cooling means is provided around the periphery of the cask for dispersing heat generated by the radioactive material being transported or stored. A lid means, detachable from the cask body, provides access to the interior of the cask. Handling means is provided for lifting and moving the cask and penetration means is provided for venting, draining and testing the interior of the cask.

Basket means is a removable compartmented basket, preferably made of metal, to hold the assemblies of the radioactive material in a segregated manner. Cavity means is a cylindrical space within the cask for holding the basket means in an upright, centralized position. Shielding means, which comprises the present invention, is two to four concentric rows of bore holes, drilled around the periphery of the cask body, which bore holes contain shielding materials which attenuate radiation emitted by the radioactive material.

In the preferred embodiment of the present invention such shielding materials contained by the bore holes would be pipes of depleted uranium, tungsten or other dense metal, to attenuate gamma radiation, encapsulating a polyethylene core, to attenuate neutrons. In an alternative, the shielding materials contained by the bore holes would be depleted uranium rods to attenuate gamma radiation and polyethylene rods for neutron attenuation. In another alternative, the shielding materials contained by the bore holes would be solely depleted uranium, tungsten or other dense metal rods, to attenuate gamma radiation. In still another alternative, the shielding materials contained by the bore holes would be solely polyethylene rods, to attenuate neutrons. In a final alternative, the shielding materials contained by the bore holes would be balls, preferably very small, of depleted uranium, tungsten or other dense metal, to attenuate gamma radiation.

The choice, mix and arrangement of the shielding materials would vary with the type and quantity of radioactive material being transported or stored. Thus, the thickness, diameter, number and arrangement of the shielding materials, e.g. pipes and rods, is varied to provide optimum protection against the neutrons and gamma radiation emitted by the particular type and quantity of radioactive material. One configuration of the cask would have the bore holes staggered in alternate rows around the periphery of the cask body. An alternative configuration would have the bore holes dispersed in a triangular pitch around the periphery of the cask body. Knowing the exact radiation characteristics of a particular radioactive material being transported or stored, enables the inventors to mathematically determine the pattern of bore holes and thickness of the shielding pipes or rods which would provide the maximum protection against radiation.

Cooling means are a series of fins integral with and encircling the outer surface of the cask body. However, the fins could also run vertically with respect to the plane of the cask body. The fins could be eliminated entirely when small heat loads are experienced. Lid means is a primary lid and a secondary lid, with gaskets, which lids are detachably secured to the top of the cask body by a plurality of closure bolts. Handling means is a plurality of removable trunnions, attached to the lower and upper portions of the cask body, for ease of handling the cask. Finally, penetration means is a flushing connection extending through the primary lid and/ or secondary lid, to provide limited access to the cavity means of the cask.

The selection of pipes of depleted uranium, tungsten or other dense metal, encapsulating polyethylene, as the preferred embodiment of the present invention, provides at least four advantages not found in the prior art:

(1) it reduces the number of bore holes that need to be drilled around the periphery of the cask body.

(2) the radius of the polyethylene core becomes a design variable to adjust the relative neutron/gamma shielding capabilities, rather than the alternative arrangement of polyethylene-filled versus depleted uranium -filled bore holes.

(3) it is believed that the ability of the polyethylene to capture neutrons may be enhanced by the higher albedo effect of the surrounding depleted uranium as compared to cast iron.

(4) it is believed that the depleted uranium may also be able to better capture neutrons because of resonance cross sections of the uranium for lower energy neutrons.

The latter two advantages are more important if the spent nuclear fuel being transported has not been allowed to decay for very long.

BRIEF DESCRIPTION OF THE DRAWINGS

FIG. 1 is a front elevational view of a cask constructed in accordance with the principles of the present invention, showing the series of fins attached to and encircling the outer surface of the cask body.

FIG. 4 is two top partial sectional views of the cask taken along line 4—4 of FIG. 2, from the direction of the arrows, showing three optional arrangements of the shielding materials of the present invention. The top sectional view shows two rows solely of depleted uranium, tungsten or other dense metal rods. The middle sectional view shows two rows of pipes of depleted uranium, tungsten or other dense metal, encapsulating a polyethylene core. The bottom sectional view shows an outer row of polyethylene rods and two inner rows of depleted uranium, tungsten or other dense metal rods.

MODES FOR CARRYING OUT THE INVENTION

Preferred Mode

Figure 3:
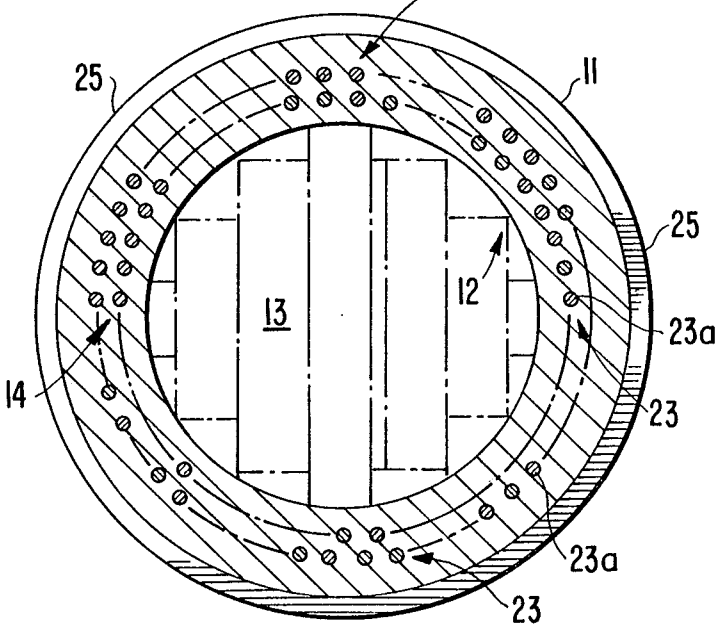
FIG. 3 is a top sectional view of the cask taken along line 3—3 of FIG. 2, from the direction of the arrows, showing one optional pitch of the bore holes of the present invention wherein the holes are staggered in alternate rows around the periphery of the cask body.

The present invention is improved shielding in a cask for transporting and storing radioactive material. Throughout the following detailed description of the present invention, like reference numerals are used to denote like parts disclosed in the accompanying drawings, FIGS. 1-4.

As shown in FIG. 1, the cask, shown generally at reference numeral 10, which contains the present invention, has a cask body 11, preferably made of ductile iron. Encased in cask body 11 is basket means, shown generally at reference numeral 12 in FIG. 2, and cavity means, shown generally at reference numeral 13. Surrounding basket means 12 and cavity means 13 is shielding means, best shown generally at reference numeral 14 in FIG. 3.

Basket means 12 is provided within cask body 11 for holding radioactive material (not shown) in a secure manner within cask 10. Cavity means 13 is provided within cask body 11 for enclosing basket means 12. Shielding means 14, which is the improvement claimed in the present invention, is provided within cask body 11, for protecting the handlers of cask 10, from radiation emitted by any radioactive material being transported or stored.

Figure 2:
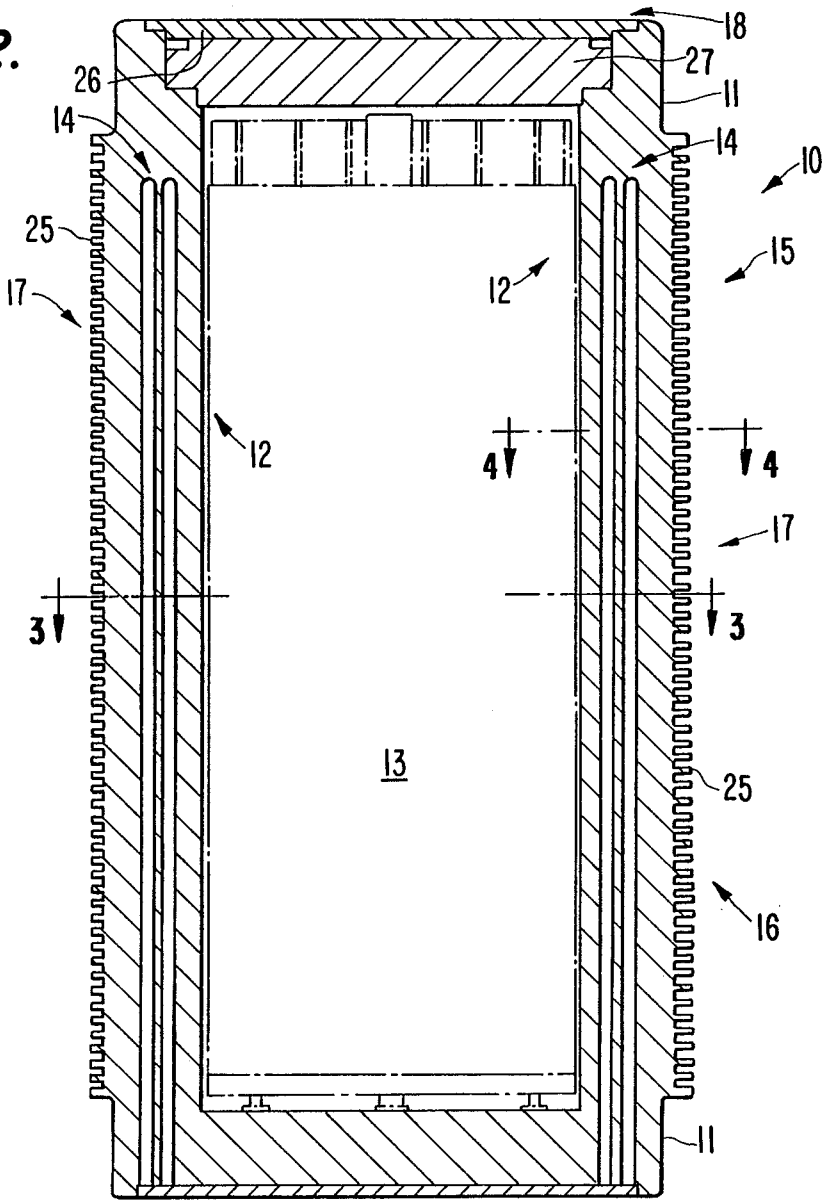
FIG. 2 is a side sectional view of the same cask taken substantially along line 2—2 in FIG. 1, looking in the direction of the arrows. Shown are the bore holes of the present invention drilled around the periphery of the cask body.

Cask body 11 has an upper portion, shown generally at reference numeral 15 and a lower portion, shown generally at reference numeral 16. Cask body 11 is provided for housing basket means 12, cavity means 13 and shielding means 14 within the same integral unit. Cooling means, shown generally at reference numeral 17 in FIGS. 1 and 2, is provided around the periphery of cask 10 for dispersing heat generated by the radioactive material being transported or stored. Lid means, shown generally at reference numeral 18 in FIG. 2, is detachable from cask body 11, to provide access to the interior of cask 10. Handling means, shown generally at reference numeral 19 in FIG. 1, is provided for lifting and moving cask 10. Penetration means (not shown) is provided in lid means 18 for venting, draining and testing the interior of cask 10.

Basket means 12 is a removable compartmented basket, preferably made of metal, to hold the assemblies of radioactive material in a segregated manner. Cavity means 13 is a cylindrical space within cask body 11 for holding basket means 12 in an upright, centralized position. Cooling means 17 is a series of fins 24 integral with and encircling the outer surface of cask body 11. Fins 25 could run horizontally or vertically with respect to the plane of cask body 11 or could be eliminated completely when small heat loads are experienced. Lid means 18 is a primary lid 26 and a secondary lid 27, with gaskets (not shown), which lids are detachably secured to the top of cask body 11 by a plurality of closure bolts (not shown). Handling means 19 is a plurality of removable trunnions 28, attached to upper portion 15 and lower portion 16 of cask body 11, for ease of handling cask 10. Penetration means, not shown, is a flushing connection extending through primary lid 26 and secondary lid 27, to provide limited access to cavity means 13 of cask 10.

Shielding means 14 is two to four concentric rows of bore holes, the rows of which are shown generally at reference numerals 20, 21, 22, 23 and 24, drilled around the periphery of cask body 11, which bore holes 20, 21, 22, 23 and 24 contain respectively shielding materials **20*a*, 21*a*, 22*a*, 23*a* and 24*a*, which attenuate radiation emitted by the radioactive material being transported or stored. In the preferred embodiment of the present invention (see middle section of FIG. 4) such shielding materials 20*a*, contained by bore holes in rows 20**, would be pipes of a very dense metal, such as depleted uranium or tungsten, to attenuate gamma radiation, encapsulating a polyethylene core, to attenuate neutrons.

The choice, mix and arrangement of the shielding materials would vary with the type and quantity of radioactive materials being transported or stored. Thus, the thickness, number and arrangement of shielding materials, e.g. pipes **20*a* or rods 21*a*, 22*a*, 23*a* or 24*a*, is varied to provide optimum protection against the neutrons and gamma radiation emitted by the particular type and quantity of radioactive material. One configuration of cask 10 (see FIG. 3) would have bore holes in rows 23 staggered in alternate rows around the periphery of cask body 11. An alternative configuration (see upper section of FIG. 4) would have bores holes in rows 24 dispersed in triangular pitch around the periphery of cask body 11. Knowing the exact radiation characteristics of a particular radioactive material being transported or stored, enables the inventors to mathematically determine the pattern of bore holes 20, 21, 22, 3 and 24 and the shielding materials, e.g. pipes 20***a* or rods 21*a*, 22*a*, 23*a* and 24*a*, which would provide the maximum protection against radiation.

Alternative Mode 1

In a alternative to the pipes as shielding materials, bore holes in rows 21 would contain rods 21*a* of depleted uranium, tungsten or other dense metal to attenuate gamma rays and bore holes in rows 22 would contain polyethylene rods 22*a*, to attenuate neutrons.

Alternative Mode 2

In another alternative, bore holes in rows 20, 21, 22, 23 or 24 would contain solely depleted uranium, tungsten or other dense metal rods 21*a*, 23*a* or 24*a*, to attenuate gamma radiation.

Alternative Mode 3

In a third alternative, bore holes in rows 20, 21, 22, 23 or 24 would contain solely polyethylene rods 22*a* to attenuate neutrons.

Alternative Mode 4

In a fourth alternative, bore holes in rows 20, 21, 22, 23 or 24 would contain balls of depleted uranium, tungsten or other dense metal 21*a*, 23*a* or 24*a*, preferably very small, to attenuate gamma radiation.

The use of pipes of depleted uranium, tungsten or other dense metal, encapsulating polyethylene (20*a*) allows the cask designer substantial flexibility in accommodating different types of spent fuel and endows the cask (10) with greater shielding capabilities than the equivalent amount of depleted uranium (21*a*, 23*a* and 24*a*) and polyethylene (22*a*) used separately as rods.

As spent nuclear fuel decays, it emits less radiation. Its ability to emit neutrons lessens more quickly than its ability to emit gamma rays as the spent fuel ages. When a designer knows that old spent fuel is to be transported, his design for transporting or storing that fuel will tend to favor depleted uranium as a shielding material rather than polyethylene because the denser uranium is a better gamma shield than polyethylene or cast iron. If the designer expects to store spent fuel that has been recently discharged from the reactor, he will prefer polyethylene to the extent necessary to provide neutron shielding.

Using polyethylene-filled, depleted uranium pipes (20*a*) permits the cask designer to alter the relative neutron/gamma ray shielding properties of a cask (10) that has existing bore holes (20, 21, 22, 23 and 24) by varying the thickness of the depleted uranium pipes (20*a*) he specifies for insertion into those bore holes. Thicker uranium pipes (20*a*) will increase the gamma ray shielding: thinner will allow a larger polyethylene core for greater neutron shielding.

Additionally, the greater uniformity of filled pipes as opposed to rods of more than one material facilitates design analyses. Also, neutrons that exit the polyethylene will more likely be reflected back by the denser uranium, thus increasing their chance of absorption.

We claim:

1. In a cask for transporting and storing radioactive material having a basket means within said cask for holding said radioactive material in a secure manner, and a cavity means within said cask for enclosing said basket means, and a shielding means within said cask for protecting handlers of said cask from the radiation emitted by any radioactive material being transported or stored, and a cask body, preferably of ductile iron, having an upper portion and lower portion, for housing said basket means, said cavity means and said shielding means, and cooling means around the periphery of said cask for dispersing heat generated by said radioactive material being transported or stored, and a lid means, detachable from said cask body, to provide access to the interior of said cask, and handling means for lifting and moving said cask, and penetration means for venting, draining and testing the interior of said cask, the improvement wherein said shielding means comprises two to four concentric rows of bore holds drilled around the periphery of said cask body which bore holes contain pipes of depleted uranium, tungsten or other dense metal, to attenuate gamma radiation, encapsulating polyethylene cores, to attenuate neutrons.

2. The cask of claim 1, wherein said bore holes are staggered in alternate rows around the periphery of said cask body.

3. The cask of claim 1 wherein said bore holes are dispersed in a triangular pitch around the periphery of said cask body.

* * * * *